US009074342B2

(12) United States Patent
Kitatani et al.

(10) Patent No.: US 9,074,342 B2
(45) Date of Patent: Jul. 7, 2015

(54) WORK VEHICLE

(75) Inventors: Taichirou Kitatani, Kawasaki (JP); Toshiharu Kurosawa, Hirakata (JP)

(73) Assignee: KOMATSU LTD., Tokyo (JP)

( * ) Notice: Subject to any disclaimer, the term of this patent is extended or adjusted under 35 U.S.C. 154(b) by 615 days.

(21) Appl. No.: 12/864,126

(22) PCT Filed: Feb. 10, 2009

(86) PCT No.: PCT/JP2009/052220

§ 371 (c)(1),
(2), (4) Date: Jul. 22, 2010

(87) PCT Pub. No.: WO2009/107483

PCT Pub. Date: Sep. 3, 2009

(65) Prior Publication Data

US 2010/0290883 A1 Nov. 18, 2010

(30) Foreign Application Priority Data

Feb. 27, 2008 (JP) ..... 2008-045955

(51) Int. Cl.
*E02F 9/18* (2006.01)
*E02F 9/08* (2006.01)

(52) U.S. Cl.
CPC ..... *E02F 9/0808* (2013.01); *E02F 9/18* (2013.01)

(58) Field of Classification Search
CPC ..... E02F 9/18; B66C 23/74
USPC ..... 414/673, 719, 720; 280/759
See application file for complete search history.

(56) References Cited

U.S. PATENT DOCUMENTS

| | | | | | |
|---|---|---|---|---|---|
| 5,141,195 | A * | 8/1992 | Toda et al. | ..... | 248/364 |
| 5,833,268 | A * | 11/1998 | Aldrovandi | ..... | 280/759 |
| 6,296,436 | B1 * | 10/2001 | Ramun | ..... | 414/719 |
| 6,938,928 | B2 * | 9/2005 | Pfohl et al. | ..... | 280/831 |
| 7,188,865 | B2 | 3/2007 | Sugiyama et al. | | |
| 2005/0210717 | A1 * | 9/2005 | Ueda et al. | ..... | 37/443 |

FOREIGN PATENT DOCUMENTS

| | | | |
|---|---|---|---|
| JP | 06-27960 | U | 4/1994 |
| JP | 08-218427 | A | 8/1996 |
| JP | 2001-90119 | A | 4/2001 |
| JP | 2001-303614 | A | 10/2001 |
| JP | 2003-239327 | A | 2/2003 |
| JP | 2004-11176 | A | 1/2004 |
| JP | 2005-163533 | A | 6/2005 |
| JP | 2006-57291 | A | 3/2006 |
| JP | 2006-335329 | A | 12/2006 |

* cited by examiner

*Primary Examiner* — Jonathan Snelting
(74) *Attorney, Agent, or Firm* — Global IP Counselors, LLP

(57) ABSTRACT

The work vehicle includes a main body frame, a counterweight, a first beam member, and a first cover member. The counterweight is placed at a rear portion of the main body frame. The counterweight forms a concave portion that is recessed rearwardly from a front surface side of the counterweight and extends to a top surface of the counterweight. The first beam member extends across the concave portion and is attached to both side ends of the counterweight. The first cover member is provided on a top surface of a first frame portion including the first beam member and the concave portion.

6 Claims, 6 Drawing Sheets

WORK VEHICLE

CROSS-REFERENCE TO RELATED APPLICATIONS

This national phase application claims priority to Japanese Patent Application No. 2008-045955 filed on Feb. 27, 2008. The entire disclosures of Japanese Patent Application No. 2008-045955 are hereby incorporated herein by reference.

TECHNICAL FIELD

The present invention relates to a work vehicle, and specifically to a work vehicle having a counterweight.

BACKGROUND ART

Hydraulic excavators are a type of work vehicle that is provided with a counterweight. The counterweight is provided to a rear portion of a main body frame in order to balance the vehicle body. A concave portion is formed on a front surface of the counterweight in order to provide an internal space for disposing an engine, a radiator, and similar devices (see Japanese Patent Publication No. 2004-11176). The concave portion is shaped so as to indent rearward from a front surface side, and covers the rear of the internal space. The top and front of the internal space are each covered by a cover member. The cover members are attached to and supported by a plurality of column members and beam members provided upright on the main body frame (Japanese Patent Publication No. 2006-335329).

SUMMARY

In a work vehicle of such description, any dimensional error in the column members and beam members has a significant effect on the accuracy of the position of the cover member. It is therefore difficult to accurately position the cover member relative to a surface of the counterweight. For example, it is difficult to install the cover member so as to be coplanar with respect to a top surface of the counterweight.

An object of the present invention is to provide a work vehicle in which a cover member can be accurately and readily positioned relative to a surface of a counterweight.

A work vehicle according to a first aspect of the invention includes a main body frame, a counterweight, a first beam member, and a first cover member. The counterweight is positioned at a rear portion of the main body frame. The counterweight forms a concave portion that is recessed rearwardly from a front surface side of the counterweight and extends to a top surface of the counterweight. The first beam member extends across the concave portion, and attached to both side ends of the counterweight. The first cover member is provided on a top surface of a first frame portion comprising the first beam member and the concave portion.

According to the work vehicle, the first cover member is supported by the first frame portion comprising the first beam member and the concave portion. The first beam member is attached to the counterweight, and the concave portion is a part of the counterweight. The cover member can therefore be accurately and readily positioned relative to the surface of the counterweight.

A work vehicle according to a second aspect of the invention is the work vehicle according to the first aspect, wherein the first cover member is preferably placed on a step portion formed along an edge of the concave portion and on the first beam member.

According to this work vehicle, the first cover member is supported by the step portion formed along the edge of the concave portion and by the first beam member. Therefore, the plurality of column members conventionally provided to support the first cover member are obviated, and the number of members for supporting the first cover member can be reduced.

A work vehicle according to a third aspect of the invention is the work vehicle according to the first aspect, preferably further including a second frame portion and a second cover member. The second frame portion is preferably positioned at a front side of the concave portion and attached to the main body frame. The second cover member is preferably supported by the second frame portion and covers a portion in front of a space surrounded by the concave portion. The first frame portion and the second frame portion are preferably provided independently of each other.

According to this work vehicle, the first frame portion is provided towards the counterweight, and the second frame portion is provided towards the main body frame. The first cover member is supported not by the second frame portion, but instead by the first frame portion. Therefore, it is possible to prevent the positional accuracy between the first cover member and the counterweight from being reduced by dimensional error in members constituting the second frame portion. Also, since the first frame portion and the second frame portion are not fixed to each other, vibration is not readily transmitted between the first frame portion and the second frame portion. Therefore, it is possible to prevent unwanted vibration from occurring, even in an instance where the vibration characteristics of the counterweight and the main frame are greatly different from each other.

A work vehicle according to a fourth aspect is a work vehicle according to the third aspect, wherein the second frame portion preferably includes a plurality of column members and a second beam member. Each of the column members is preferably attached to the main body frame and extends along the vertical direction. The second beam member is preferably supported by the column members and extends along the first beam member so as to face the first beam member. The first beam member and the second beam member are provided independently of each other. The work vehicle further comprises a seal member. The seal member closes a gap between the first beam member and the second beam member.

According to this work vehicle, the first beam member and the second beam member are not fixed to each other, and vibration is not readily transmitted between the first frame portion and the second frame portion. Also, since the gap between the first beam member and the second beam member is closed by the seal member, it is possible to increase the sealing property of the internal space.

A work vehicle according to a fifth aspect of the invention is the work vehicle according to the fourth aspect, preferably further including one of a hydraulic oil tank and a fuel tank. The one of the hydraulic oil tank and the fuel tank is preferably provided at a position in front of the first beam member and to a side of the second beam member. The seal member preferably further closes a gap between the first beam member and the one of the hydraulic oil tank and the fuel tank.

According to this work vehicle, the gap between the first beam member and the hydraulic oil tank or the fuel tank is closed by the seal member, and the sealing property of the internal space can therefore be further enhanced.

DETAILED DESCRIPTION OF EMBODIMENTS

Overall Structure

Figure 1:
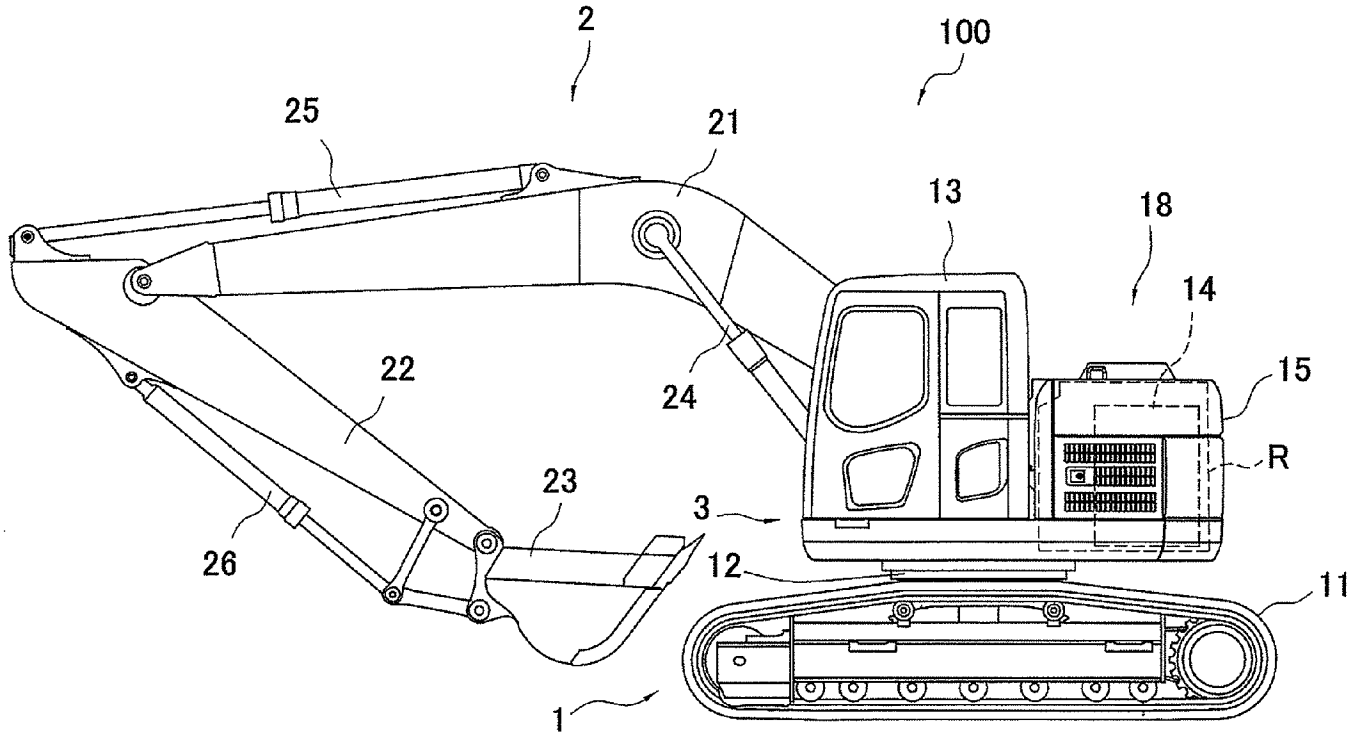
FIG. 1 is a side view of a work vehicle.

A work vehicle 100 according to an embodiment of the present invention is shown in FIG. 1. FIG. 1 is a side view of the work vehicle 100. The work vehicle 100 is what is commonly called a hydraulic excavator, comprising a travel unit 1, a work equipment 2, and a revolving unit 3. The tent's "transverse," "longitudinal," "front surface," and "rear surface" used in the description below refer to directions relative to the direction that the operator faces when seated on a seat inside a cab 13 (i.e., the direction facing the work equipment 2 from a counterweight 15 in FIG. 1).

The travel unit 1 includes a track-type travelling mechanism. A track 11 is rotationally driven, whereby the work vehicle 100 is caused to move.

The work equipment 2 is attached to a front portion of the revolving unit 3, and is used for performing excavation and a variety of similar tasks. The work equipment 2 includes a boom 21, an arm 22, a bucket 23, and a variety of hydraulic cylinders 24 through 26. The boom 21 is rotatably attached to the revolving unit 3 and driven by the boom cylinder 24. The arm 22 is rotatably attached to the boom 21 and is driven by the arm cylinder 25. The bucket 23 is rotatably attached to the arm 22 and is driven by the bucket cylinder 26. The work equipment 2 can perform excavation and similar tasks while using the hydraulic cylinders 24 through 26 to move the boom 21, the arm 22, and the bucket 23 in the vertical direction.

The revolving unit 3 is placed on the travel unit 1 with a rotating device 12 interposed therebetween, and is capable of rotating about a rotation axis extending in the vertical direction. The structure of the revolving unit 3 will now be described in detail.

Detailed Structure of Revolving Unit 3

Figure 2:
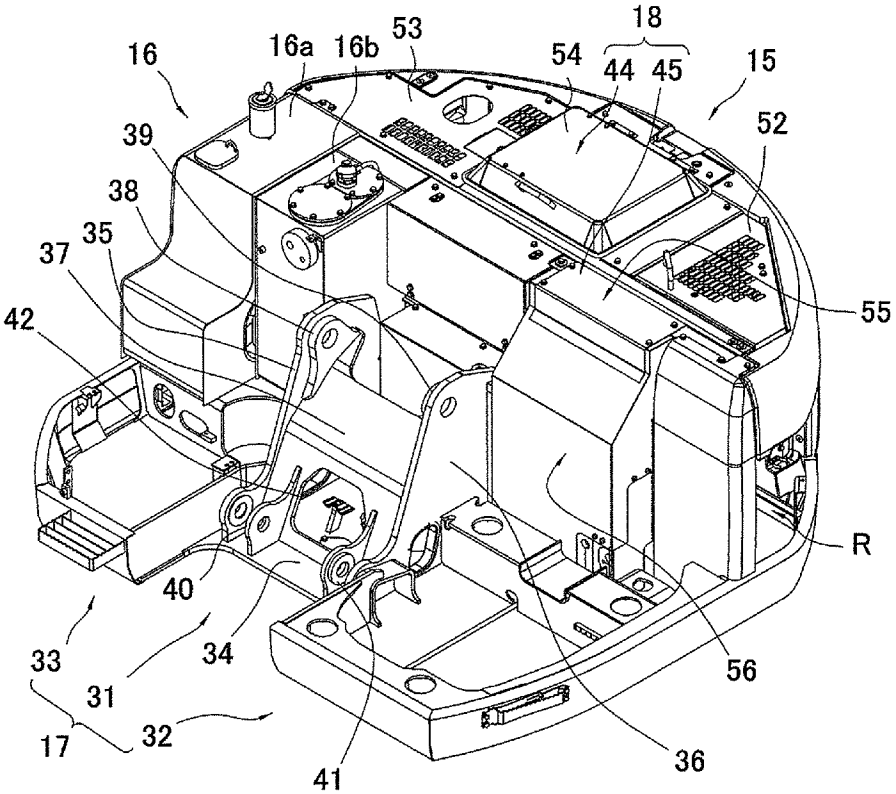
FIG. 2 is a perspective view showing a part of a structure of a revolving unit.

As shown in FIG. 1, the revolving unit 3 includes the cab 13, an engine 14, and the counterweight 15. As shown in FIG. 2, the revolving unit 3 further includes a tank section 16, a main body frame 17, an external cover 18, a first frame portion 19 (see FIGS. 3 and 4), and a second frame portion 20 (see FIGS. 3, 4, and 6).

The cab 13 is a box-shaped structure having an operator space formed within. A seat for seating the operator; levers, pedals and other operation members; and a variety of instruments are provided within the cab 13 (not shown). The cab 13 is placed on a left-side front portion of the main body frame 17, and is positioned towards the left of the work equipment 2. More specifically, the cab 13 is placed to the left of a pair of vertical plate portions 35, 36 described further below (see FIG. 2) and to the front of an engine compartment R described further below.

The tank section 16 shown in FIG. 2 includes a fuel tank 16*a*, a hydraulic oil tank 16*b*, and pipework for such components (not shown). The tank section 16 is placed on a right-side front portion of the main body frame 17, and is positioned to the right of the work equipment 2. More specifically, the tank section 16 is placed to the right of the pair of vertical plate portions 35, 36 and to the front of the engine compartment R.

The engine 14 shown in FIG. 1 is a driving source for driving the travel unit 1 and the work equipment 2, and is provided within the engine compartment R.

The main body frame 17 shown in FIG. 2 is a frame onto which the cab 13, the engine 14, the counterweight 15, and other components are placed; and comprises a center frame 31, a first side frame 32, and a second side frame 33.

The center frame 31 is positioned at the center of the main body frame 17 in the transverse direction, and is a portion attached to the aforementioned rotating device 12. The center frame 31 includes a bottom surface portion 34, the pair of vertical plate portions 35, 36, and a front plate portion 37.

The bottom surface portion 34 constitutes a bottom surface of the center frame 31, and is a horizontally disposed, plate-shaped member.

The vertical plate portions 35, 36 are plate-shaped members extending in the longitudinal direction, and are provided upright on the bottom surface portion 34. The vertical plate portions 35, 36 are provided on the bottom surface portion 34 so as to be set apart from each other in the transverse direction.

The front plate portion 37 is provided between respective front end portions of each of the vertical plate portions 35, 36 in order to reinforce the vertical plate portions 35, 36. Brackets 38 through 41 are provided on the front plate portion 37. A hole penetrating in the transverse direction is provided on each of the brackets 38 through 41. A hole is also provided on each section of the vertical plate portions 35, 36 that faces the brackets 38 through 41, and the work equipment 2 is attached between the vertical plate portions 35, 36 using a locking pin (not shown) that passes through the holes. An opening 42 is provided on a lower portion of the front plate portion 37, and a hydraulic pipe extending to the hydraulic cylinders 24 through 26 of the work equipment 2 passes through the opening 42.

The first side frame 32 is connected to a left-side portion of the center frame 31. The cab 13 is placed on a front portion of the first side frame 32.

The second side frame 33 is connected to a right side portion of the center frame 31. The tank section 16 is placed on the second side frame 33.

Figure 3:
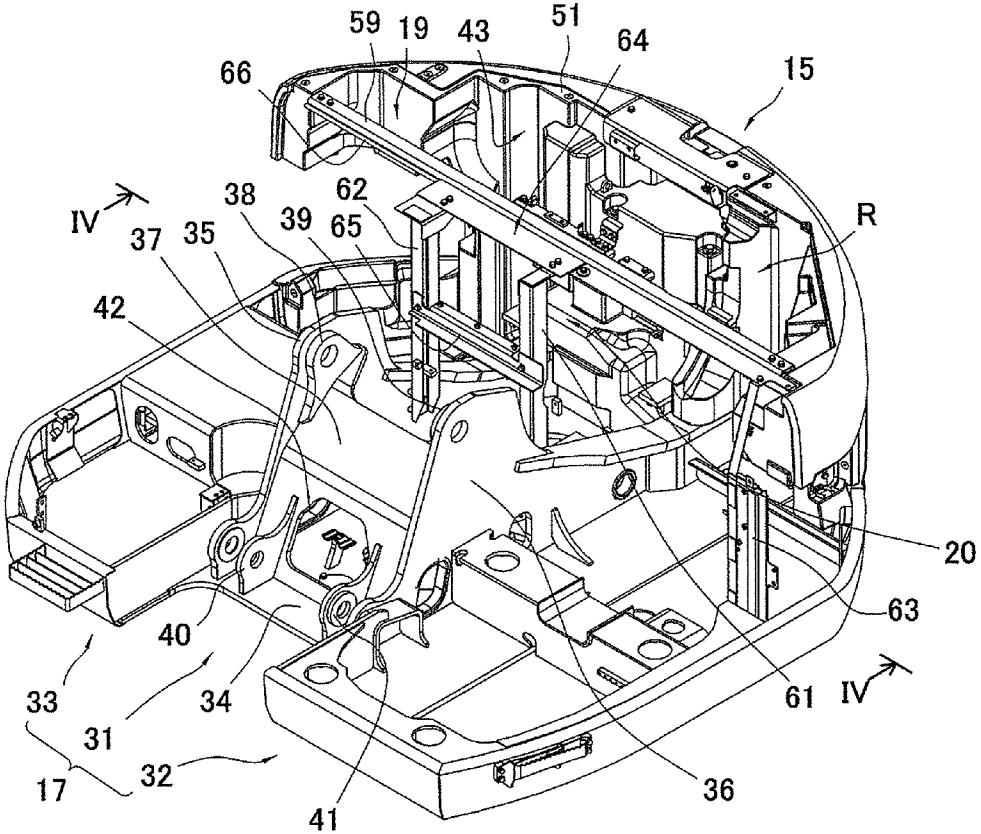
FIG. 3 is a perspective view showing a frame structure of the revolving unit.
Figure 4:
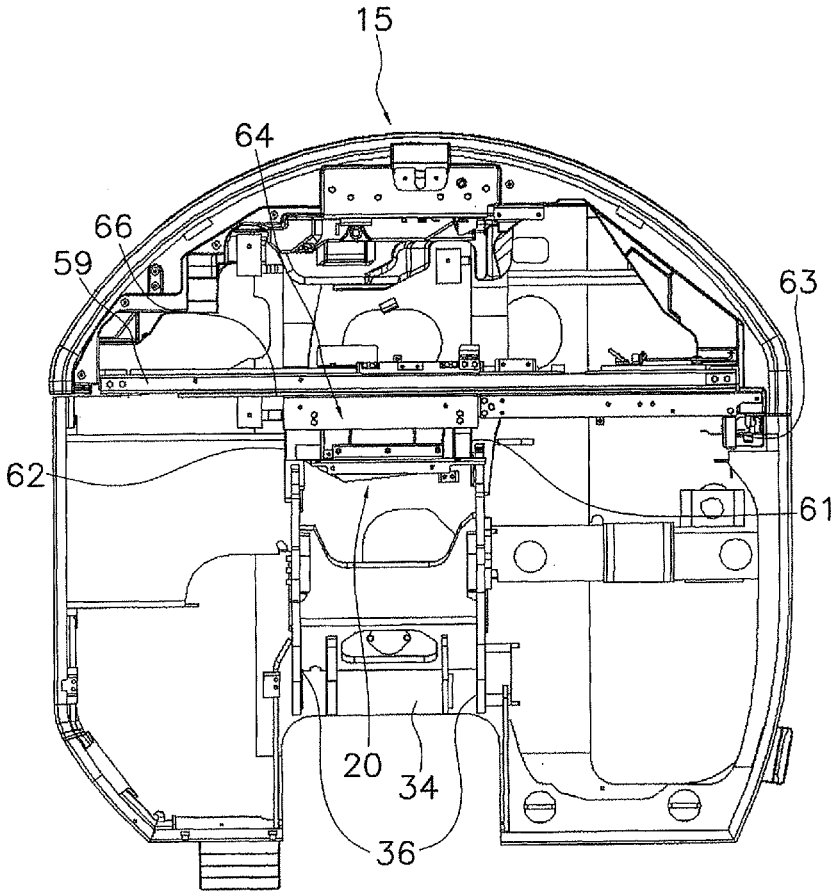
FIG. 4 is a top view showing the frame structure of the revolving unit.

The counterweight 15 is provided on a rear portion of the main body frame 17 in order to balance the vehicle body during excavation or similar work. The counterweight 15 is formed, for example, by placing scrap iron, concrete or a similar material in a box and causing it to set, the box being formed from an assembly of steel plates. A back surface of the counterweight 15 faces an exterior of the work vehicle 100, and has a smoothly curved shape. Meanwhile, as shown in FIGS. 3 and 4, a front surface of the counterweight 15 has a complex irregular shape, and forms a concave portion 43 shaped overall so as to indent rearward from the front surface side. The concave portion 43 extends to a top surface of the counterweight 15, and a first cover member 44 (see FIG. 2) described further below covers the top of a space surrounded by the concave portion 43. The space covered by the concave portion 43, i.e., the space at a front side of the concave portion 43, constitutes the engine compartment R in which the engine 14 is disposed. A step portion 51 is formed on the top surface of the counterweight 15 along an edge of the concave portion 43. The step portion 51 is slightly lower than other portions of the top surface of the counterweight 15. A rear end portion or a side end portion of the first cover member 44 described further below is placed on the step portion 51.

The external cover 18 shown in FIG. 2 is disposed so as to face an exterior of the work vehicle 100, and constitutes an exterior surface of a rear portion of the revolving unit 3. The external cover 18 includes the first cover member 44 and a second cover member 45.

The first cover member 44 is supported by the first frame portion 19 (see FIGS. 3 and 4). The first cover member 44 comprises a plurality of separate members, and is provided so as to extend across a gap between a first beam member 59 (see FIGS. 3 and 4) described further below and the top surface of the counterweight 15. Therefore, the rear end portion and the side end portion of the first cover member 44 are shaped to correspond to the step portion 51 of the counterweight 15. Also, a front end portion of the first cover member 44 has a linear shape so as to follow the first beam member 59. The first cover member 44 includes a first member 52, a second member 53, and a third member 54. The first member 52 is positioned to the left of the third member 54, and the second member 53 is positioned to the right of the third member 54. The third member 54 is positioned between the first member 52 and the second member 53. A top surface of the third member 54 is positioned higher than the top surface of the counterweight 15; however, a top surface of the first member 52 and a top surface of the second member 53 are positioned so as to be substantially coplanar with respect to the top surface of the counterweight 15.

The second cover member 45 is supported by the second frame portion 20 (see FIGS. 3 and 4). The second cover member 45 covers the front and the top of the engine compartment R. The second cover member 45 includes an upper surface portion 55 and a partition portion 56.

The upper surface portion 55 is positioned on a second beam member 64 (see FIGS. 3 and 4) described further below, and is provided so as to be substantially coplanar with respect to the top surface of the counterweight 15 and the top surface of the first cover member 44. Also, a top surface of the hydraulic oil tank 16*b* is located to the right of the upper surface portion 55, and the upper surface portion 55 is provided so as to be substantially coplanar also with respect to the top surface of the hydraulic oil tank 16*b*. A rear end portion of the upper surface portion 55 has a linear shape so as to follow the second beam member 64, and faces the front end portion of the first cover member 44. Together with the first cover member 44, the upper surface portion 55 covers the top of the engine compartment R.

The partition portion 56 is disposed along a substantially vertical direction, and a top end of the partition portion 56 is connected to a front end of the upper surface portion 55. The partition portion 56 covers the front of the engine compartment R and partitions the engine compartment R from other spaces.

As shown in FIGS. 3 and 4, the first frame portion 19 comprises one first beam member 59 and the concave portion 43 of the counterweight 15. The first beam member 59 is provided so as to extend across a right-side end portion and a left-side end portion of the concave portion 43, and is disposed horizontally. The first beam member 59 is attached to opposite side ends of the counterweight 15 at the right-side end portion and the left-side end portion of the concave portion 43, and is secured by a bolt or other securing means.

The second frame portion 20 is positioned at a front side of the concave portion 43, and is attached to the main body frame 17. The second frame portion 20 includes a plurality of column members 61 through 63 and a plurality of beam members 64, 65.

The column members 61 through 63 are attached to the main body frame 17 and are provided along the vertical direction. The column members 61 through 63 comprise a first column member 61, a second column member 62, and a third column member 63.

Figure 5:
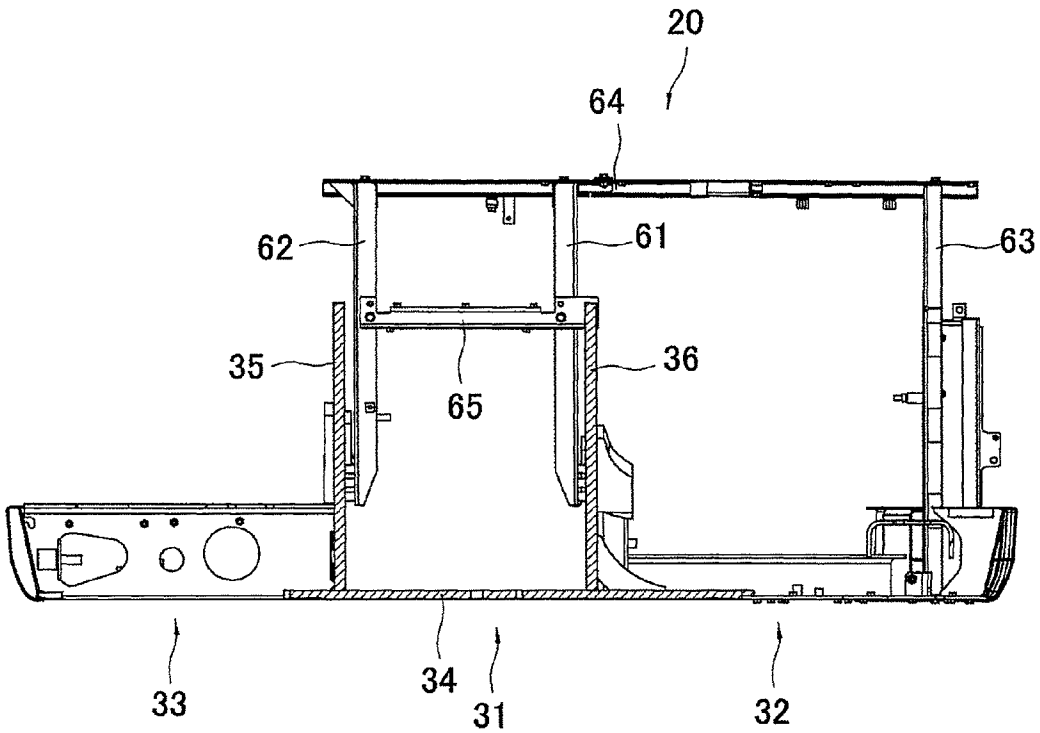
FIG. 5 is a cross-sectional view taken along IV-IV in FIG. 3.

Of the vertical plate portions 35, 36, the vertical plate portion 36 is adjacent to the cab 13, and the first column member 61 is fixed on an inside surface of the vertical plate portion 36. The first column member 61 is secured to the vertical plate portion 36 by a bolt or other securing means. As shown in FIG. 5, a lower end portion of the first column member 61 is positioned higher than the bottom surface portion 34. FIG. 5 is a cross-sectional view taken along IV-IV in FIG. 3, but the counterweight 15, a part of the main body frame 17, and other portions are omitted for purposes of clarification.

The second column member 62 is positioned so as to be set apart by a distance in the transverse direction from the first column member 61, and is provided so as to be bilaterally symmetrical with respect to the first column member 61. The second column member 62 is secured to an inside surface of the vertical plate portion 35, which is the vertical plate portion among vertical plate portions 35, 36 to which the first column member 61 is not attached. Similarly to the first column member 61, the second column member 62 is secured to the vertical plate portion 35 by a bolt or other securing means. A lower end portion of the second column member 62 is positioned higher than the bottom surface portion 34.

The third column member 63 is positioned so as to be set apart in the transverse direction from the first column member 61 and the second column member 62. The third column member 63 is provided at a position that is to the left of the vertical plate portions 35, 36 and rearward of the cab 13. A lower end portion of the third column member 63 is secured to the first side frame 32 by a bolt or other securing means.

The beam members 64, 65 comprise the second beam member 64 and a third beam member 65.

The second beam member 64 is provided so as to extend across the first column member 61, the second column member 62, and the third column member 63. The second beam member 64 is secured to a top end portion of the first column member 61, the second column member 62, and the third column member 63; and is supported by the first column member 61, the second column member 62, and the third column member 63. As described above, the second beam member 64 supports the upper surface portion 55 of the second cover member 45 (see FIG. 2). The second beam member 64 is disposed horizontally, and is disposed along the first beam member 59 and facing the first beam member 59. Nevertheless, the first beam member 59 and the second beam member 64 are not secured to each other, and a seal member 66 for closing a gap between the first beam member 59 and the second beam member 64 is provided therebetween as shown in FIGS. 3 and 4.

Also, the tank section 16 is provided to a side of the second beam member 64 (see FIG. 2). The tank section 16 is positioned forward of the first beam member 59, and the first beam member 59 is positioned so as to face the second beam member 64 and the tank section 16 that are provided alongside each other in the direction of vehicle width. The aforementioned seal member 66 is attached to the first beam member 59 and also closes a gap between the tank section 16 and the first beam member 59.

The third beam member 65 is provided so as to extend across the first column member 61 and the second column member 62. The third beam member 65 is secured to a center portion in the vertical direction of each of the first beam member 59 and the second beam member 64, and reinforces the first column member 61 and the second column member 62.

Figure 6:
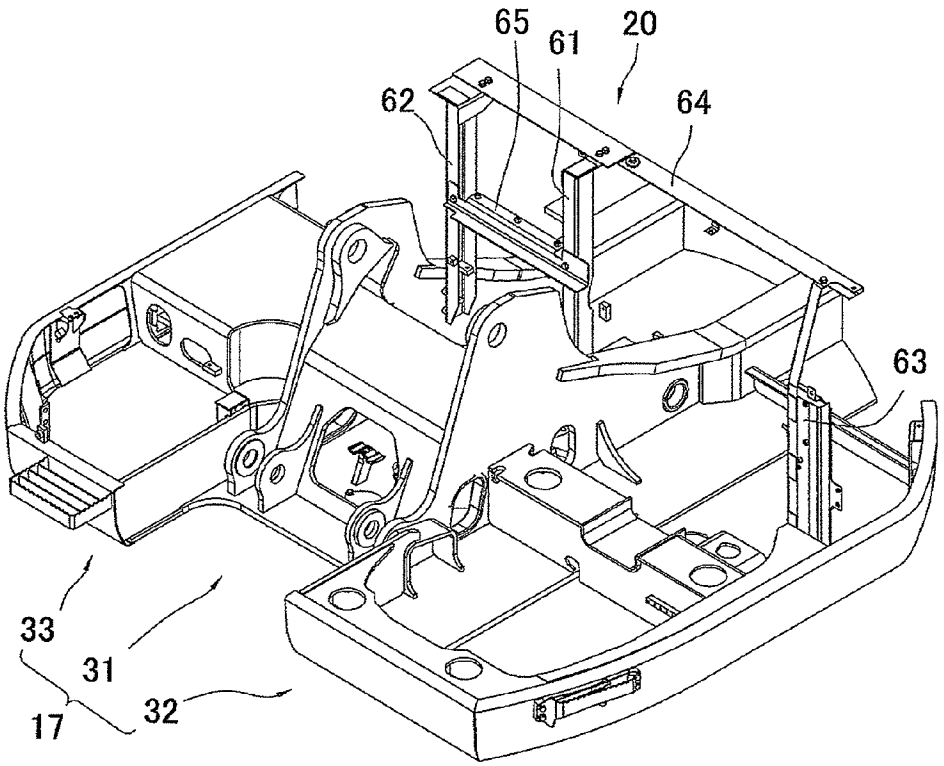
FIG. 6 is a view showing the frame structure of the revolving unit in a state in which the counterweight has been removed from FIG. 3.

As described above, the first frame portion 19 and the second frame portion 20 are not secured to each other, and are instead provided independently of each other. Therefore, the counterweight 15 can be detached from the main body frame 17 while a state in which the first beam member 59 remains attached is maintained. When the counterweight 15 is detached from the main body frame 17, the first beam member 59 is detached from the main body frame 17 and the second frame portion 20 remains on the main body frame 17, as shown in FIG. 6.

Characteristics

According to this work vehicle 100, the first cover member 44 is supported by the first frame portion 19. Also, the first frame portion 19 is not provided to the main body frame 17. Rather, the first frame portion 19 comprises the first beam member 59 and the concave portion 43 of the counterweight 15. Therefore, the first cover member 44 can be accurately positioned relative to the counterweight 15. Also, the first cover member 44 is not attached to the second frame portion 20. Therefore, the position of the first cover member 44 is not affected by dimensional error in the second frame portion 20. Also, even in an instance where the first cover member 44 is attached at a position that moderately deviates from the correct position, there is no need to adjust the position of the second frame portion 20 which includes a large number of members; therefore, positional adjustment can be performed with ease. According to the work vehicle 100, the first cover member 44 can thereby be readily disposed so as to be coplanar with respect to the top surface of the counterweight 15.

Also, according to the work vehicle 100, the first frame portion 19 comprises the first beam member 59 and the concave portion 43 of the counterweight 15, and the second frame portion 20 is attached to the main body frame 17. Since the first frame portion 19 and the second frame portion 20 are not secured to each other, transmission of vibration between the first frame portion 19 and the second frame portion 20 is minimized. Accordingly, unwanted vibration is prevented from occurring in the work vehicle 100, even in an instance where the vibration characteristics of the counterweight 15 and the main frame 17 are different from each other.

Also, according to the work vehicle 100, the counterweight 15 can be detached from the main body frame 17 while a state in which the first beam member 59 remains attached is maintained. Accordingly, the first frame portion 19 can be manufactured as an assembly via a process that is separate from a process of the manufacturing of the main body frame 17. The process of manufacturing the work vehicle 100 can therefore be simplified.

Other Embodiments

According to the embodiment described above, the first frame portion 19 comprises the counterweight 15 and the first beam member 59. However, the first frame portion 19 may also include another member provided so as to extend in the longitudinal direction of the vehicle body, in addition to the counterweight 15 and the first beam member 59. However, in terms of reducing the number of components, it is preferable for the first frame portion 19 to comprise the counterweight 15 and the first beam member 59 as described above, or the smallest possible number of members.

According to the embodiment described above, the top surface of the counterweight 15 and the top surface of the external cover 18 are disposed horizontally; however, they may be disposed at an incline. Also, the case where the top surface of the counterweight 15 is disposed so as to be coplanar with respect to the top surface of the external cover 18 is not by way of limitation; the external cover 18 may be disposed at a slightly higher position relative to the top surface of the counterweight 15, or may instead be disposed at a slightly lower position.

According to the embodiment described above, a hydraulic excavator is used as an example of the work vehicle 100. However, the work vehicle 100 may be another type of work vehicle that has a counterweight 15.

The work vehicle of the illustrated embodiment is effective in making it possible to readily and accurately position a cover member relative to a surface of a counterweight, and can be usefully applied to a work vehicle.

The invention claimed is:

1. A work vehicle comprising:

a main body frame;

a counterweight positioned at a rear portion of the main body frame, the counterweight forming a concave portion that is recessed rearwardly from a front surface side of the counterweight and extends to a top surface of the counterweight;

a first beam member extending across the concave portion between a right side end and a left side end of the counterweight, the first beam member being fixed to the right side end and the left side end of the counterweight with fasteners;

a first cover member provided on a top surface of a first frame portion including the first beam member and the concave portion, the top surface of the first frame portion being defined by a top surface of the first beam member and the top surface of the counterweight, the first cover member spanning between the top surface of the first beam member and the top surface of the counterweight so as to cover a space surrounded by the concave portion:

a second frame portion positioned at a front side of the concave portion and attached to the main body frame, and a second cover member supported by the second frame portion and covering a portion in front of a space surrounded by the concave portion, the first frame portion and the second frame portion being provided independently of each other.

2. The work vehicle according to claim 1, wherein the first cover member is placed on a step portion formed along an edge of the concave portion and on the first beam member.

3. The work vehicle according to claim 1, wherein the second frame portion includes a plurality of column members attached to the main body frame and extending along a vertical direction, and a second beam member supported by the column members and extending along the first beam member so as to face the first beam member, the first beam member and the second beam member being provided independently of each other, with a seal member being disposed between the first beam member and the second beam member to close a gap formed between the first beam member and the second beam member.

4. The work vehicle according to claim 3, further comprising one of a hydraulic oil tank and a fuel tank, provided at a position in front of the first beam member and to a side of the second beam member, the seal member also closing a gap between the first beam member and the one of the hydraulic oil tank and the fuel tank.

5. The work vehicle according to claim 1, wherein the first frame portion is not secured to the second frame portion.

6. The work vehicle according to claim 3, wherein the first beam member is not secured to the second beam member.

* * * * *